US005253990A

United States Patent [19]

Hutchins

[11] Patent Number: 5,253,990

[45] Date of Patent: Oct. 19, 1993

[54] FLUID DEVICE WITH WEAR REDUCING ROTOR ASSEMBLY

[75] Inventor: Alma A. Hutchins, Pasadena, Calif.

[73] Assignee: Hutchins Manufacturing Company, Pasadena, Calif.

[21] Appl. No.: 939,731

[22] Filed: Sep. 2, 1992

[51] Int. Cl.[5] ..... F01C 21/00; F03C 2/00

[52] U.S. Cl. ..... 418/270; 416/244 R

[58] Field of Search ..... 418/182, 270; 416/204 R, 244 R

[56] References Cited

U.S. PATENT DOCUMENTS 3,031,216 4/1962 Shaw ..... 416/244 R
3,656,785 4/1972 Lothar ..... 416/204 R
4,660,329 4/1987 Hutchins ..... 51/170 MT
4,986,036 1/1991 Hutchins ..... 418/178

*Primary Examiner*—Richard A. Bertsch
*Assistant Examiner*—Charles G. Freay
*Attorney, Agent, or Firm*—William P. Green

[57] ABSTRACT

A rotary fluid motor or pump including a rotor mounted to turn about an axis within a housing, and a shaft extending through a passage in the rotor and turning with it, with a key being received within opposed grooves in the rotor and shaft, and with a fastener being connected threadedly to the shaft and being operable by threaded adjustment relative to the shaft to urge the key radially outwardly toward the rotor and thereby rigidly lock the rotor and shaft against relative movement.

19 Claims, 3 Drawing Sheets

FLUID DEVICE WITH WEAR REDUCING ROTOR ASSEMBLY

This invention relates to improved wear reducing rotor assemblies for fluid driven motors or fluid pumps. The invention is in certain respects especially useful in connection with air driven motors for powered hand tools, such as portable powered sanders, and will be described primarily as applied to that use.

BACKGROUND OF THE INVENTION

U.S. Pat. Nos. 4,660,329 and 4,986,036 disclose power sanders having air driven motors including a housing containing a chamber through which pressurized air is directed, and a rotor contained in the housing and driven rotatively by the air. A shaft extends vertically through a central passage in the rotor and is driven by the rotor and acts in turn to power a shoe carrying sandpaper for abrading a work piece. The shaft is journalled for rotation in the housing by bearings carried by upper and lower walls of the housing, and is connected to the rotor by a key acting to transmit rotary motion between the rotor and shaft.

One problem which has been encountered in motors of this general type results from the tendency for the rotor to move slightly relative to the driven shaft when repeatedly subjected to very high starting and stopping torques and other unpredictable and varying forces during a sanding operation. This relative shifting movement of the rotor and contained shaft, though initially very slight, gradually increases over a period of time causing the shaft, the passage in the rotor through which the shaft extends, and the key to wear progressively and allow increasing relative motion of the parts ultimately resulting in such damage to the rotor and shaft and housing walls as to require their replacement. The above mentioned patents show an arrangement for reducing this wear by providing a leaf spring radially between the rotor and key for yieldingly urging the rotor transversely of the axis of the device relative to the shaft and key and thereby resisting relative displacement of these parts when the motor is operating.

SUMMARY OF THE INVENTION

The present invention provides an improved rotor assembly for further reducing the tendency for wear of the rotor and other parts in a rotary fluid handling device such as a motor or a rotary fluid pump. A device embodying the invention includes a key received within opposed grooves in the rotor and shaft as in the above discussed patents, but in addition includes means carried by the shaft for applying force to the key in a manner tightening it generally radially outwardly toward the rotor to positively lock the rotor and shaft against relative displacement. This force may be exerted by a fastener carried by the shaft and threadedly adjustable relative thereto. Preferably, the fastener is a set screw which is threadedly adjustable axially within the shaft, and which has a camming relationship with the key acting to urge the key radially outwardly in response to axial movement of the set screw. The key may apply its axial force against a ball contained within the shaft, with the ball acting to cam the key radially outwardly. A leaf spring of the type disclosed in U.S. Pat. No. 4,660,329 may be interposed radially between the key and an opposed surface of the rotor.

BRIEF DESCRIPTION OF THE DRAWINGS

The above and other features and objects of the invention will be better understood from the following detailed description of the typical embodiments illustrated in the accompanying drawings, in which.

DESCRIPTION OF THE PREFERRED EMBODIMENTS

Figure 1:
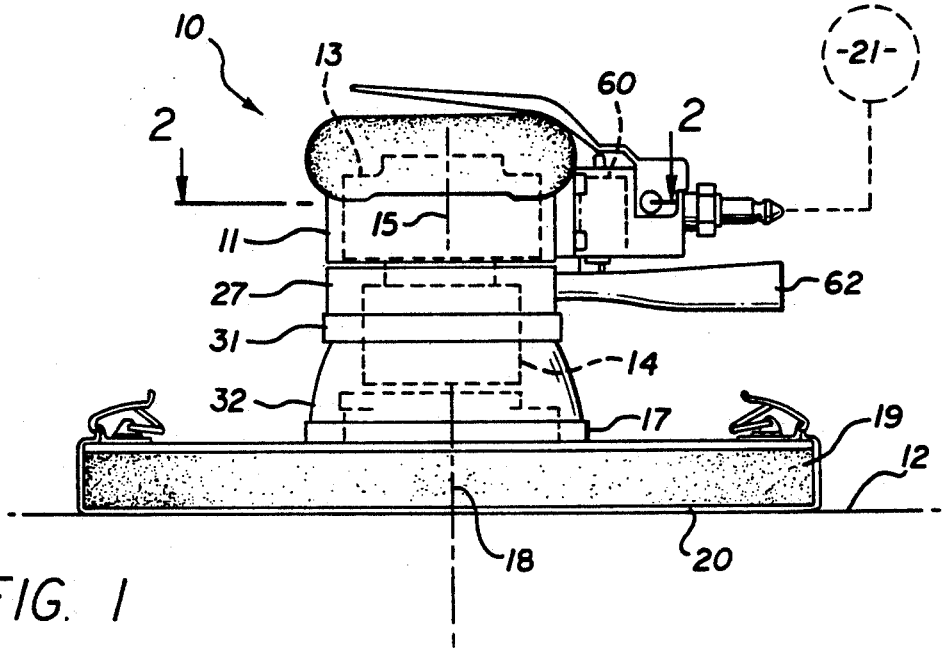
FIG. 1 is a side elevational view of an orbital sander containing an air motor incorporating the features of the present invention.
Figure 3:
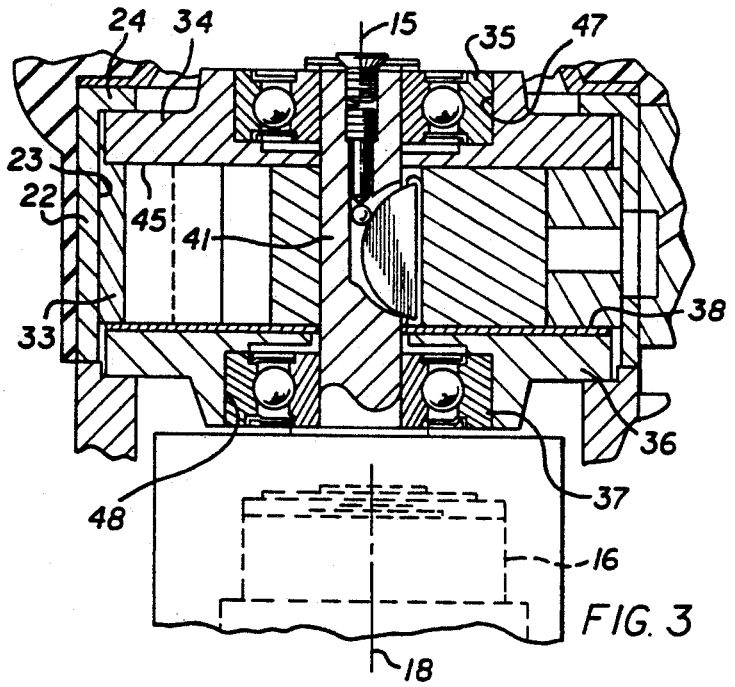
FIG. 3 is a fragmentary vertical section through the motor taken on line 3—3 of FIG. 2.

The orbital sander 10 shown in FIG. 1 includes a body structure 11 shaped externally as a handle to be grasped by a user for holding the tool and moving it along a work surface 12 to abrade that surface. An air driven rotary motor 13 embodying the invention is contained within body structure 11 and drives a carrier part 14 rotatively about a vertical axis 15. Part 14 contains bearings represented at 16 in FIG. 3, which mount a part 17 at the underside of carrier 14 for rotation relative to carrier 14 about a second vertical axis 18 offset from but parallel to the principal axis 15. The parts 14 and 17, and bearings 16, thus form an orbital drive connection acting to move part 17 and a carried abrading head or shoe 19 and sheet of sandpaper 20 attached thereto orbitally about the principal axis 15 to abrade surface 12. Air is supplied to motor 13 from a source 21 of compressed air.

Figure 2:
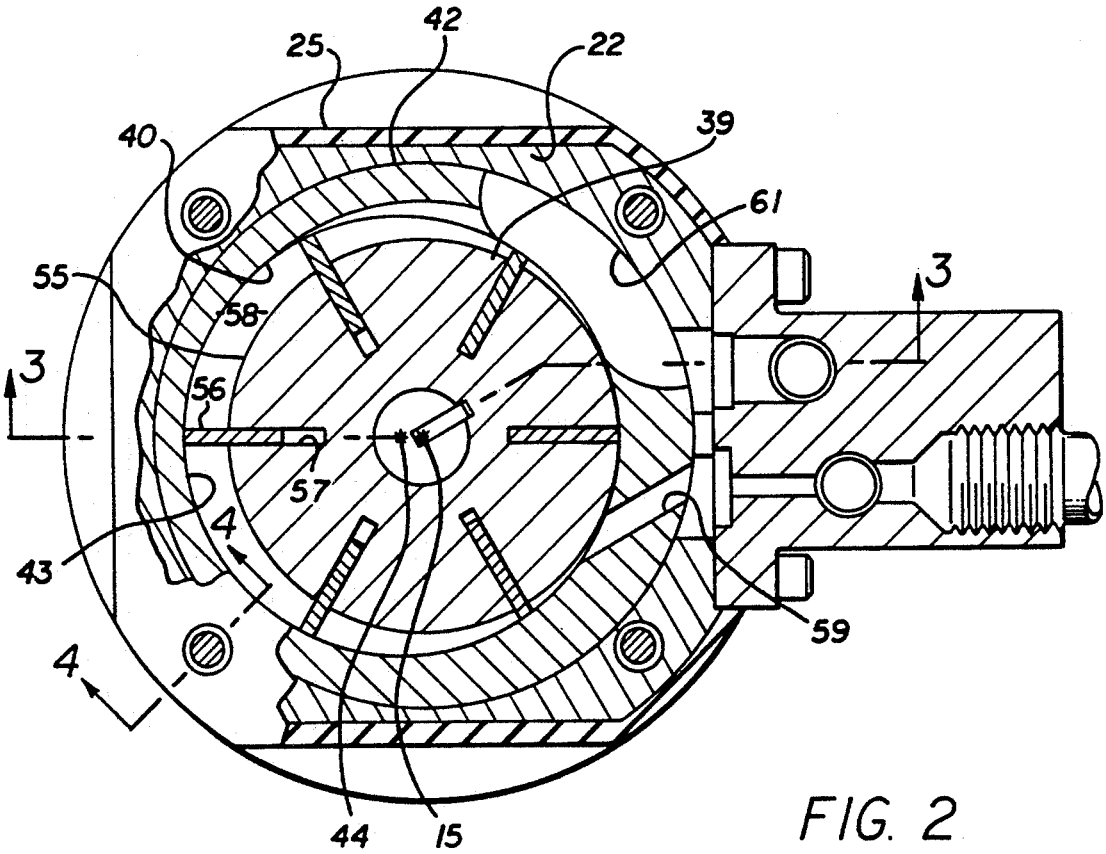
FIG. 2 is an enlarged horizontal section through the motor of the FIG. 1 sander, taken primarily on line 2—2 ot FIG. 1.
Figure 4:
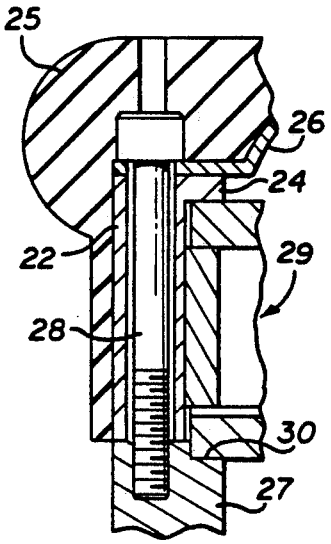
FIG. 4 is a fragmentary vertical section taken on line 4—4 of FIG. 2.

The body structure 11 of the tool may be formed as an assembly of parts including a hollow rigid metal body part 22 (FIGS. 2 and 3) having a cylindrical internal surface 23 defining a recess within which motor 13 is received. Part 22 may be externally essentially square as seen in FIG. 2, and at its upper end may have an annular horizontal flange 24 for confining the motor parts against upward removal from the body. A cushioning element 25 is carried about body part 22 and functions as a cushioned handle element by which the device is held in use during a sanding operation. A rigid reinforcing element 26 bonded to the undersurface of handle cushion 25 is secured to body part 22 and to an annular member 27 at the underside of body part 22 by four screws 28 (FIG. 4) extending downwardly through vertically aligned openings or passages in parts 26 and 22, with the heads of the screws engaging downwardly against part 26 and with the lower ends of the screws being connected threadedly to member 27. Upon tightening of screws 28, several elements of a sectionally formed stator or housing 29 of motor 13 are clamped vertically between top flange 24 of body part 22 and an upwardly facing annular horizontal shoulder surface 30 of member 27. The lower portion of member 27 is connected by an annular clamp 31 to a tubular rubber boot 32 whose lower end is connected to sanding head 19 to retain it against rotation while permitting orbital movement of head 19 and the sandpaper by virtue of the flexibility of boot 32.

The stator or housing assembly 29 of motor 13 includes a vertically extending side wall 33, a top wall 34 carrying a bearing 35 and a bottom wall 36 carrying a second bearing 37. A horizontal circular wear plate 38 is located above bottom wall 36. A rotor 39 is contained within the motor chamber 40 formed by housing parts 33, 34 and 36, and is connected to an upper cylindrical shaft portion 41 of carrier part 14, to drive that part rotatively about axis 15. Side wall 33 of the motor housing has an external cylindrical surface 42 which fits closely within and engages internal cylindrical surface 23 of body part 22. Internally, side wall 33 of the motor assembly has a vertical cylindrical surface 43 which is eccentric with respect to the principal axis 15 of the motor, and is centered about a vertical axis 44. The top and bottom of motor chamber 40 are defined by a horizontal undersurface 45 of top wall 34 of the motor housing assembly and by the upper horizontal surface of wear plate 38. Bearings 35 and 37 may be ball bearings whose outer races are close fits within recesses 47 and 48 in the top and bottom walls 34 and 36 respectively.

At its upper end, cylindrical shaft 41 of carrier part 14 has a planar upper end surface 49 disposed horizontally and perpendicular to axis 15, and contains a bore or passage 50 which extends downwardly into the interior of shaft 41. The side wall of passage 50 forms a thread 51 centered about axis 15 and extending downwardly from the upper end of shaft 41 to a location 52. Beneath that location, passage 50 has a cylindrical side wall 53 centered about axis 15 and terminating at a lower end 54 of the passage. A retaining screw 155 is threadedly connected into the upper end of passage 50, and bears downwardly against an annular washer 83, which in turn bears against a spring washer 84 engaging the inner race of the upper bearing 35 to retain shaft 41 against downward withdrawal from the bearings and other elements of the motor.

Rotor 39 has a vertical cylindrical external surface 55 centered about axis 15, and carries a series of vanes 56 received slidably within radial slots 57 in the rotor and engageable with the eccentric internal surface 43 of the side wall 33 of the motor chamber, to form a series of air compartments 58 circularly between the vanes which vary progresively in size as the rotor turns. Air is introduced into these compartments through an inlet passage 59 in the side wall 33 of the motor under the control of a manually actuated air inlet valve 60 to produce rotation of the rotor in a clockwise direction as viewed in FIG. 2. Air leaves the motor chamber through a circularly elongated air outlet opening 61 in side wall 33, leading to an exhaust tube 62. The upper and lower surfaces of rotor 39 and the vanes are horizontal and engage surface 45 and disc 38 at the top and bottom of the motor chamber in closely fitting relation to prevent air flow from one of the air compartments 58 to another.

The features of the sander 10 and its motor 13 thus far described are present in the sander and motor of prior U.S. Pat. No. 4,986,036. The present invention is concerned with the provision in such an arrangement of an improved connection between rotor body 39 and shaft 41 driven thereby. In the form of the invention illustrated in FIGS. 1 through 7, that connection includes a key 65 interfitting with both the rotor body and shaft, a camming ball 66, a screw 67 for tightening the ball against the key, and a leaf spring 68 at the outer side of the key.

Figure 5:
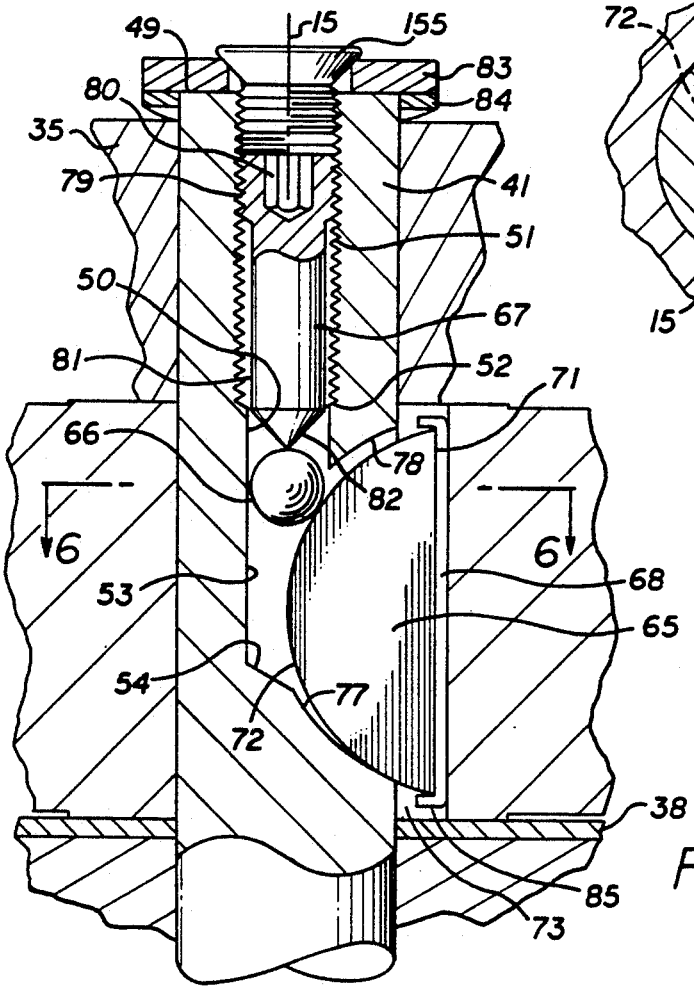
FIG. 5 is an enlarged vertical section corresponding to a portion of FIG. 3 and showing in greater detail the arrangement for forming a rigid connection between the rotor body and contained shaft and preventing relative displacement of these parts.
Figure 6:
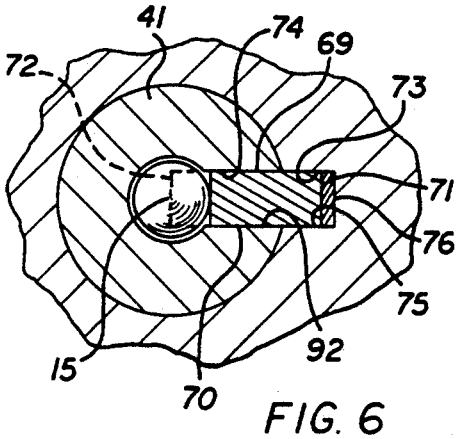
FIG. 6 is a fragmentary horizontal section taken on line 6—6 of FIG. 5.

As seen best in FIGS. 5 and 6, key 65 may be a standard woodruff key having two parallel planar opposite side surfaces 69 and 70 lying in planes extending parallel to and spaced equal distances at opposite sides of axis 15. At its radially outer side, the key has a planar surface 71 extending parallel to axis 15 and facing radially outwardly away from that axis. At its radially inner side, key 65 has a surface 72 which is curved essentially semi-circularly as shown. The key is received partially within a groove 92 formed in shaft 41, and partially within a groove 73 formed in rotor body 39, to key the parts rotatively together. Groove 92 in the shaft has parallel planar opposite side walls 74 engaging opposite side surfaces 69 and 70 of the key in closely fitting relation. Similarly, the groove 73 in rotor body 39 has parallel planar opposite side walls 75 engaging the opposite side surfaces 69 and 70 of the key in closely fitting relation. A third wall 76 of groove 73 extends between walls 75 and perpendicular thereto, and faces radially inwardly toward and is parallel to axis 15 of the shaft. This wall 76 of groove 73 is thus parallel to the radially outwardly facing outer surface 71 of key 65.

Camming element 66 is a hardened metal ball whose external spherical surface is engageable with inner surface 72 of key 65 in a camming relation to urge key 65 radially outwardly in response to downward displacement of ball 66 by adjusting screw 67. Ball 66 is of a diameter slightly less than the lower unthreaded cylindrical portion 53 of axial bore 50 in the shaft. As seen in FIG. 5, the lower end of bore 50 intersects and communicates with the radially inner portion of keyway groove 92 in the shaft. Groove 92 as seen in axial section may have the configuration illustrated in FIG. 5, with inner walls 77 and 78 of the groove curving as shown generally in correspondence with the inner curved surface 72 of the key.

The upper portion of screw 67 has an external thread 79 which engages internal thread 51 in the shaft to allow upward and downward threaded adjusting movement of screw 67 within bore 50 and along axis 15. An upwardly facing recess 80 in the screw, of hexagonal horizontal cross section, is adapted to be engaged by an allen wrench to turn screw 67 within bore 50 for adjusting the screw upwardly and downwardly. The lower portion of screw 67 may have a cylindrical external surface 81 fitting closely within cylindrical surface 53 of bore 50 and terminating downwardly at a conically tapering bottom end surface 82 of the screw centered about axis 15.

Leaf spring 68 is received at the radially outer side of key 65, radially between outer surface 71 of the key and the opposed wall 76 of groove 73 in the rotor body. As seen in FIG. 6, the leaf spring has a width corresponding to that of key 65, to occupy the entire width of groove 73 between its side wall surfaces 75. At its opposite ends as viewed in FIG. 5, the leaf spring has portions 85 turned inwardly toward axis 15 and fitting about and closely engaging the opposite ends of semi-circularly curved surface 72 of the key, to hold the spring on the key during assembly of the parts. The leaf spring normally tends by its own resilience to assume the bowed condition illustrated in FIG. 7, and can be flattened to the straight condition of FIG. 5 by tightening screw 67.

Figure 7:
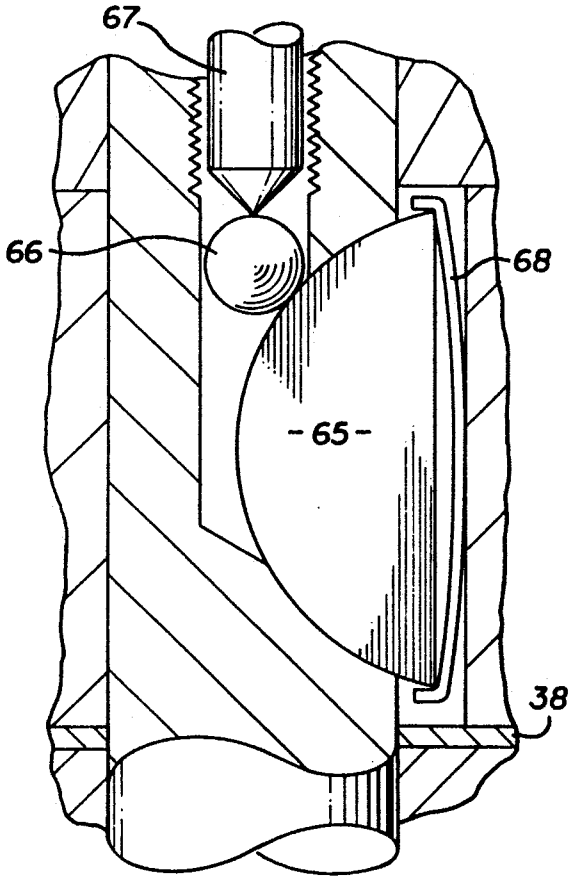
FIG. 7 is a view similar to FIG. 5 but showing the set screw, ball, key and leaf spring before the screw has been tightened to form the rigid connection between the parts.

To now describe the manner of assembly of rotor body 39 on shaft 14 of the motor, assume that initially the rotor body and parts 55, 65, 66, 67 and 68 are all completely detached from shaft 41. A first step in the assembly process may be to attach leaf spring 68 to the outer surface of key 65, with the turned ends 85 of the key retaining the leaf spring on the key, and with the leaf spring bowed as illustrated in FIG. 7. This two piece assembly of the key and leaf spring may then be inserted into keyway groove 92 in shaft 41, to a position similar to that illustrated in FIG. 7, after which the rotor body 39 may be slid axially onto shaft 41, with the radially outer portion of the key and leaf spring sliding into groove 73 in the rotor body. The metal camming ball 66 may then be inserted into bore 50 in the shaft, followed by screw 67, which may be threadedly advanced downwardly by an allen wrench to the FIG. 7 position in which the screw commences to press the ball downwardly against an upper portion of the curved radially inner surface 72 of the key. The screw is tightened downwardly against ball 66, with resultant camming of the key radially outwardly by the ball. During such radially outward movement of the key, leaf spring 68 which had initially engaged wall 76 of groove 73 in the rotor body only at a central location (FIG. 7) is gradually deformed to the flattened condition of FIG. 5 in which the key bears tightly radially outwardly against the leaf spring along its entire axial length, and the leaf spring in turn bears tightly radially outwardly against wall 76 of groove 73 in the rotor body along the entire axial length of the leaf spring. The screw is tightened sufficiently to rigidly lock the rotor body 39, shaft 41, key 65, ball 66, adjusting screw 67, and leaf spring 68 in fixed positions relative to one another preventing even slight relative displacement of any of these parts during a sanding operation. After such connection of the rotor body to the shaft, top wall 34 and its carried upper bearing 35 of the motor may be moved into position on the upper end of the shaft, and be retained by screw 55 and washers 83 and 84.

Figure 8:
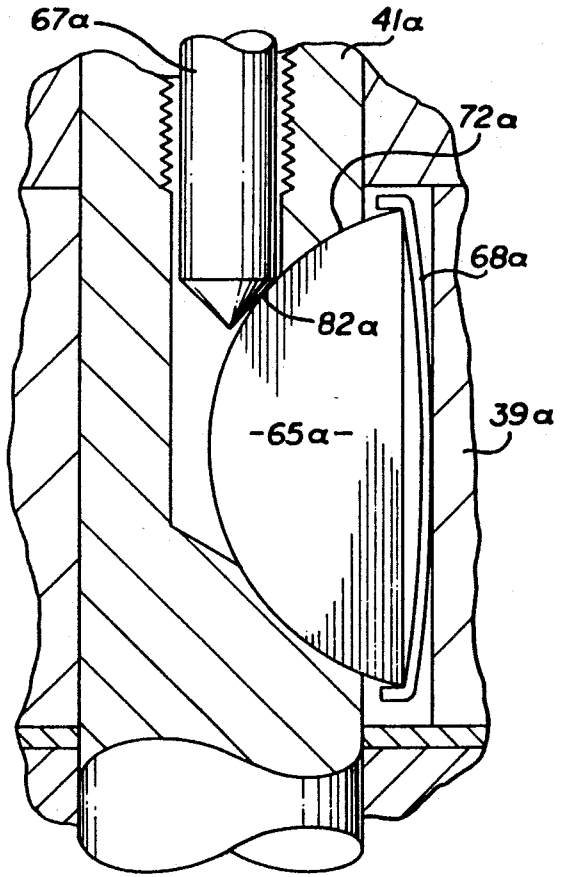

FIG. 8 shows a variational arrangement similar to that illustrated in FIGS. 5 through 7 but in which the ball 66 is omitted, and the tapered lower end surface 82*a* of screw 67*a* directly engages the inner curved surface 72*a* of key 65*a*. The camming relationship between surfaces 72*a* and 82*a* acts to force the key radially outwardly upon downward tightening of screw 67*a* in a manner similar to that discussed in connection with FIGS. 5 through 7, to flatten the initially bowed leaf spring 68*a* and form the desired rigid connection between the rotor body 39*a* and shaft 41*a*.

Figure 9:
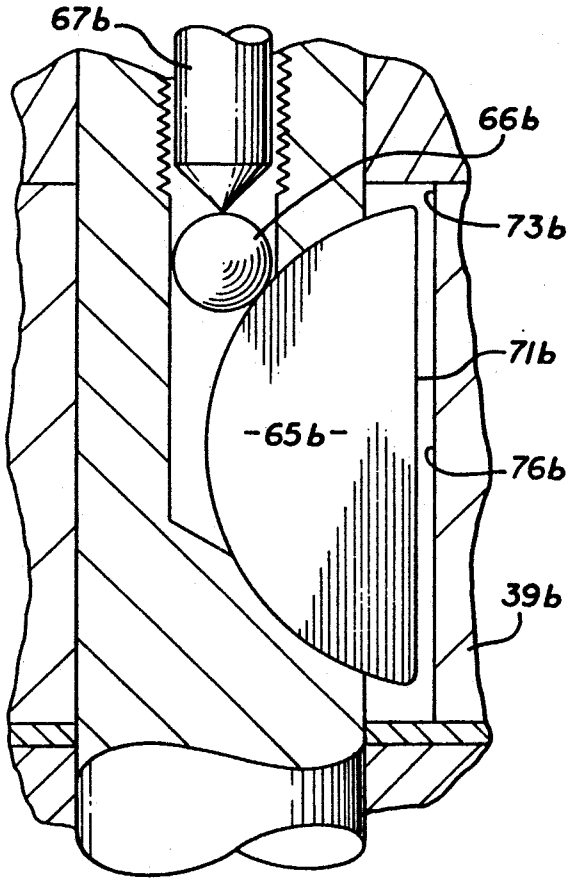
FIGS. 8 and 9 are views similar to FIG. 5 but showing two variational arrangements.

FIG. 9 shows another variational arrangement which is the same as that of FIGS. 5 to 7 except that the leaf spring 68 is omitted. Radially outer surface 71*b* of the key 65*b* then directly engages inwardly facing surface 76*b* of keyway groove 73*b* in the rotor body 39*b* to form the rigid connection between the parts. As in the first form of the invention, downward tightening of screw 67*b* forces ball 66*b* against the key, to cam it radially outwardly.

As a further variation which will be understood without specific illustration, both the ball 66 and leaf spring 68 may in some instances be omitted, with screw 67 bearing directly against the key in camming relation as illustrated in FIG. 8, and with the key bearing directly radially outwardly against the rotor body as in the FIG. 9 arrangement.

While certain specific embodiments of the present invention have been disclosed as typical, the invention is not limited to these particular forms, but rather is applicable broadly to all such variations as fall within the scope of the appended claims.

I claim:

1. A fluid device comprising:

a rotor;

a housing containing a chamber through which fluid flows as the rotor turns about an axis relative to the housing;

a shaft extending through a passage in the rotor and turning therewith;

said rotor having an inner surface containing an axially extending groove and said shaft having an outer surface containing an axially extending groove opposite said groove of the rotor;

a key received partially within said groove of the rotor and partially within said groove of the shaft and keying the rotor and shaft rotatively together;

a fastener connected threadedly to said shaft and operable by threaded adjustment relative thereto to urge said key radially outwardly toward the rotor and thereby rigidly lock the rotor and shaft against relative movement; and a leaf spring contained within said groove in the rotor radially between the key and rotor and which acts to resist outward displacement of the key by said fastener relative to the rotor and shaft.

2. A fluid device as recited in claim 1, in which said fastener is adjustable relative to the shaft essentially parallel to said axis of the rotor.

3. A fluid device as recited in claim 1, in which said fastener is threadedly adjustable essentially parallel to said axis of the rotor, there being camming means for urging said key radially outwardly relative to the shaft and rotor in response to axial adjusting movement of the fastener relative to the shaft.

4. A fluid device comprising:

a rotor;

a housing containing a chamber through which fluid flows as the rotor turns about an axis relative to the housing;

a shaft extending through a passage in the rotor and turning therewith;

said rotor having an inner surface containing an axially extending groove and said shaft having an outer surface containing an axially extending groove opposite said groove of the rotor;

a key received partially within said groove of the rotor and partially within said groove of the shaft and keying the rotor and shaft rotatively together; and a fastener contained within the interior of said shaft and connected threadedly to said shaft and operable by threaded adjustment relative thereto to urge said key radially outwardly toward the rotor and thereby rigidly lock the rotor and shaft against relative movement.

5. A fluid device as recited in claim 4, including a leaf spring contained in said groove in the rotor radially outwardly of said key and which acts to resist outward displacement of the key relative to the rotor and shaft.

6. A fluid device comprising:

a rotor;

a housing containing a chamber through which fluid flows as the rotor turns about an axis relative to the housing;

a shaft extending through a passage in the rotor and turning therewith;

said rotor having an inner surface containing an axially extending groove and said shaft having an outer surface containing an axially extending groove opposite said groove of the rotor;

a key received partially within said groove of the rotor and partially within said groove of the shaft and keying the rotor and shaft rotatively together;

a fastener connected threadedly to said shaft and operable by threaded adjustment relative thereto to urge said key radially outwardly toward the rotor and thereby rigidly lock the rotor and shaft against relative movement; and an element interposed between said fastener and said key and acting to force the key radially outwardly in response to threaded adjustment of the fastener relative to said shaft.

7. A fluid device as recited in claim 6, in which said element is a ball.

8. A fluid device as recited in claim 6, including a leaf spring contained in said groove in the rotor radially outwardly of said key and which acts to resist outward displacement of the key relative to the rotor and shaft.

9. A fluid device comprising:

a rotor;

a housing containing a chamber through which fluid flows as the rotor turns about an axis relative to the housing;

a shaft extending through a passage in the rotor and turning therewith;

said rotor having an inner surface containing an axially extending groove and said shaft having an outer surface containing an axially extending groove opposite said groove of the rotor;

a key received partially within said groove of the rotor and partially within said groove of the shaft and keying the rotor and shaft rotatively together;

a fastener connected threadedly to said shaft and operable by threaded adjustment relative thereto to urge said key radially outwardly toward the rotor and thereby rigidly lock the rotor and shaft against relative movement;

said housing including a side wall and an end wall;

a bearing connected to said end wall and having inner and outer races; and a second fastener connected threadedly to said shaft and acting to retain said inner race of the bearing.

10. A fluid device comprising:

a rotor;

a housing containing a chamber through which fluid flows as the rotor turns about an axis relative to the housing;

a shaft extending through a passage in the rotor and turning therewith;

said rotor having an inner surface containing an axially extending groove and said shaft having an outer surface containing an axially extending groove opposite said groove of the rotor;

a key received partially within said groove of the rotor and partially within said groove of the shaft and keying the rotor and shaft rotatively together;

a fastener connected threadedly to said shaft and operable by threaded adjustment relative thereto to urge said key radially outwardly toward the rotor and thereby rigidly lock the rotor and shaft against relative movement;

said housing including a side wall and an end wall;

a bearing connected to said end wall and having inner and outer races;

said shaft containing a passage extending thereinto from an end of the shaft and within which said fastener is threadedly connected to the shaft; and a second fastener threadedly connected into said passage in the shaft and acting to retain said inner race of said bearing.

11. A fluid device as recited in claim 10, in which said passage in the shaft contains a thread to which both of said fasteners are threadedly connected.

12. A fluid device comprising:

a rotor;

a housing containing a chamber through which fluid flows as the rotor turns about an axis relative to the housing;

a shaft extending through a passage in the rotor and turning therewith;

said rotor having an inner surface containing an axially extending groove and said shaft having an outer surface containing an axially extending groove opposite said groove of the rotor;

a key received partially within said groove of the rotor and partially within said groove of the shaft and keying the rotor and shaft rotatively together; and a fastener connected threadedly to said shaft and operable by threaded adjustment relative thereto to urge said key radially outwardly toward the rotor and thereby rigidly lock the rotor and shaft against relative movement;

said fastener being contained within the interior of said shaft and being threadedly adjustable relative thereto essentially parallel to said axis of the rotor.

13. A fluid device comprising:

a rotor;

a housing containing a chamber through which fluid flows as the rotor turns about an axis relative to the housing;

a shaft extending through a passage in the rotor and turning therewith;

said rotor having an inner surface containing an axially extending groove and said shaft having an outer surface containing an axially extending groove opposite said groove of the rotor;

a key received partially within said groove of the rotor and partially within said groove of the shaft and keying the rotor and shaft rotatively together; and a fastener connected threadedly to said shaft and operable by threaded adjustment relative thereto to urge said key radially outwardly toward the rotor and thereby rigidly lock the rotor and shaft against relative movement;

said key having an essentially arcuately curved inner surface within the shaft against which said fastener applies force generally axially in a camming relation acting to urge the key radially outwardly in response to axial adjustment of the fastener relative to the shaft.

14. A fluid device as recited in claim 13, including a leaf spring contained in said groove in the rotor radially outwardly of said key and which acts to resist outward displacement of the key relative to the rotor and shaft.

15. A fluid device comprising:

a rotor;

a housing containing a chamber through which fluid flows as the rotor turns about an axis relative to the housing;

a shaft extending through a passage in the rotor and turning therewith;

said rotor having an inner surface containing an axially extending groove and said shaft having an outer surface containing an axially extending groove opposite said groove of the rotor;

a key received partially within said groove of the rotor and partially within said groove of the shaft and keying the rotor and shaft rotatively together; and a fastener connected threadedly to said shaft and operable by threaded adjustment relative thereto to urge said key radially outwardly toward the rotor and thereby rigidly lock the rotor and shaft against relative movement;

said shaft containing a passage extending into an end of the shaft essentially along said axis and opening into said groove in the shaft;

said passage in the shaft containing a thread centered essentially about said axis and engaging an external thread on said fastener to connect the fastener and shaft for said threaded adjustment;

said key having a radially outer surface extending essentially parallel to said axis for applying force to the rotor;

said key having an inner surface curved essentially acruately and to which said fastener applies force in a camming relation acting to tighten the key radially outwardly in response to axial adjustment of the fastener.

16. A fluid device as recited in claim 15, including a ball within said passage engaged by said fastener and said curved surface of the key to cam the key radially outwardly upon axial adjustment of the fastener.

17. A fluid device as recited in claim 16, in which said housing includes a sidewall and an end wall, there being a bearing connected to said end wall and having inner and outer races, and a second fastener threadedly connected into said passage in the shaft and retaining said inner race of the bearing.

18. A fluid device as recited in claim 17, including a leaf spring contained in said groove in the rotor radially outwardly of said key and which acts to resist outward displacement of the key relative to the rotor and shaft.

19. A fluid device as recited in claim 16, including a leaf spring contained within said groove in the rotor and interposed radially between the key and the rotor.

* * * * *